US009249941B2

(12) United States Patent
Inoue et al.

(10) Patent No.: US 9,249,941 B2
(45) Date of Patent: Feb. 2, 2016

(54) VEHICLE LAMP

(75) Inventors: Takashi Inoue, Shizuoka (JP); Masaru Sasaki, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 1646 days.

(21) Appl. No.: 12/427,428

(22) Filed: Apr. 21, 2009

(65) Prior Publication Data

US 2009/0262549 A1 Oct. 22, 2009

(30) Foreign Application Priority Data

Apr. 22, 2008 (JP) ..... 2008-111816

(51) Int. Cl.

| | |
|---|---|
| ***F21S 8/10*** | (2006.01) |
| ***F21V 29/00*** | (2015.01) |
| ***F21V 29/75*** | (2015.01) |
| ***F21V 29/76*** | (2015.01) |

(52) U.S. Cl.

CPC ..... *F21S 48/10* (2013.01); *F21S 48/1145* (2013.01); *F21S 48/32* (2013.01); *F21S 48/328* (2013.01); *F21V 29/004* (2013.01); *F21V 29/75* (2015.01); *F21V 29/76* (2015.01)

(58) Field of Classification Search

CPC ..... F21S 48/323; F21S 48/325–48/326; F21S 48/328; F21V 29/004; F21V 29/2212; F21V 29/74; F21V 29/75; F21Y 2101/02

USPC ..... 362/547

See application file for complete search history.

(56) References Cited

U.S. PATENT DOCUMENTS

| | | | | |
|---|---|---|---|---|
| 5,150,278 | A * | 9/1992 | Lynes et al. | 361/690 |
| 5,513,071 | A * | 4/1996 | LaViolette et al. | 361/703 |
| 6,065,530 | A * | 5/2000 | Austin et al. | 165/80.3 |
| 7,114,837 | B2 * | 10/2006 | Yagi et al. | 362/523 |
| 7,249,868 | B2 * | 7/2007 | Chinniah et al. | 362/294 |

(Continued)

FOREIGN PATENT DOCUMENTS

| | | |
|---|---|---|
| FR | 2853717 A1 | 10/2004 |
| JP | 2006-286395 A | 10/2006 |

(Continued)

OTHER PUBLICATIONS

Notification of the First Office Action dated Apr. 6, 2010, issued in counterpart Chinese Application No. 200910133988.8 (7 pages).

(Continued)

*Primary Examiner* — Robert May

(74) *Attorney, Agent, or Firm* — Sughrue Mion, PLLC

(57) ABSTRACT

A vehicle lamp includes a semiconductor light emitting device, a thermally conductive portion which is in contact with the semiconductor light emitting device, a heatsink which dissipates heat generated by the semiconductor light emitting device, and a housing in which the semiconductor light emitting device, the thermally conductive portion and the heatsink are accommodated. The heatsink includes a base and plate fins arranged at intervals to protrude from the base. Each of the plate fins includes a plate surface facing the plate surface of an adjacent one of the plate fins and upwardly extending in a direction along the base. A plane parallel to at least one of the plate surfaces of the plate fins may be oblique with respect to a vertical direction. An inner surface of the housing may be oblique with respect to the vertical direction in a region above the plate fins.

5 Claims, 5 Drawing Sheets

(56) References Cited

U.S. PATENT DOCUMENTS

| | | | | |
|---|---|---|---|---|
| 7,300,191 | B2 * | 11/2007 | Oshio et al. | 362/545 |
| 7,325,955 | B2 * | 2/2008 | Lucas et al. | 362/545 |
| 7,329,033 | B2 * | 2/2008 | Glovatsky et al. | 362/547 |
| 7,344,289 | B2 * | 3/2008 | Fallahi et al. | 362/547 |
| 7,535,716 | B2 * | 5/2009 | Fischer et al. | 361/714 |
| 7,686,488 | B2 * | 3/2010 | Inoue et al. | 362/509 |
| 2004/0202007 | A1 | 10/2004 | Yagi et al. | |
| 2006/0181894 | A1 * | 8/2006 | Chinniah et al. | 362/547 |
| 2006/0215416 | A1 | 9/2006 | Lucas et al. | |
| 2007/0008727 | A1 | 1/2007 | Chinniah et al. | |
| 2007/0025105 | A1 * | 2/2007 | Inoue et al. | 362/250 |
| 2007/0076422 | A1 * | 4/2007 | Nicolai | 362/547 |
| 2007/0127257 | A1 * | 6/2007 | Erion et al. | 362/547 |

FOREIGN PATENT DOCUMENTS

| | | | |
|---|---|---|---|
| JP | 2006-294263 | A | 10/2006 |
| JP | 2008059965 | A | 3/2008 |
| WO | 2005/025932 | A2 | 3/2005 |

OTHER PUBLICATIONS

Partial European Search Report dated Aug. 3, 2009.

Extended European Search Report dated Nov. 20, 2009 in Application No. 09005522.9.

Japanese Office Action dated Aug. 7, 2012, issued in corresponding Japanese Patent Application No. 2008-111816.

Communication from the Japanese Patent Office dated Apr. 2, 2013, in a counterpart application No. 2008-111816.

* cited by examiner

VEHICLE LAMP

CROSS-REFERENCE TO RELATED APPLICATION

The present application claims priority from Japanese Patent Application No. 2008-111816 filed on Apr. 22, 2008, the entire content of which is incorporated herein by reference.

FIELD OF INVENTION

Apparatuses and devices consistent with the present invention relate to a vehicle lamp having a semiconductor light emitting device as a light source.

DESCRIPTION OF RELATED ART

Related art vehicle lamps have a semiconductor light emitting device, e.g., a light emitting diode (LED), as a light source. In a case of using a semiconductor light emitting device as a light source of a vehicle lamp, efforts are made to use light emission from the semiconductor light emitting device as much as possible in order produce sufficient light for the vehicle lamp.

Generally, a higher output of the semiconductor light emitting device can be obtained by supplying a larger amount of electric current to the semiconductor light emitting device. However, as the electric current supplied to the semiconductor light emitting device increases, a heat generated by the semiconductor light emitting device increases, and if the temperature of the semiconductor light emitting device becomes high due to the heat generation, luminous efficiency of the semiconductor light emitting device decreases. Thus, in order to efficiently dissipate the heat generated by the semiconductor light emitting device, various heat dissipating structures have been proposed (see, e.g., JP 2006-286395 A).

Some related art vehicle lamps are configured such that a semiconductor light emitting device, an optical system for irradiating light emitted from the semiconductor light emitting device toward an outside of a housing, and a heatsink for dissipating heat emitted from the semiconductor light emitting device are accommodated inside a hermetically-sealed housing.

In this configuration, the heat from the semiconductor light emitting device is radiated into the air inside the housing via the heatsink. When the air inside the housing is warmed by the heat, natural convection is caused so that the air circulates inside the housing to further dissipate the heat emitted from the semiconductor light emitting device. Accordingly, in order to efficiently dissipate the heat emitted from the semiconductor light emitting device, it is desirable to enhance the air circulation inside the housing.

SUMMARY OF INVENTION

Illustrative aspects of the present invention provide a vehicle lamp in which an air circulation inside a housing of the vehicle lamp is enhanced to efficiently dissipate a heat generated by a semiconductor light emitting device.

According to an illustrative aspect of the present invention, a vehicle lamp includes a semiconductor light emitting device, a thermally conductive portion which is in contact with the semiconductor light emitting device, a heatsink configured to dissipate a heat generated by the semiconductor light emitting device, and a housing in which the semiconductor light emitting device, the thermally conductive portion and the heatsink are accommodated. The heatsink includes a base which is in contact with the thermally conductive portion, and a plurality of plate fins which are arranged at intervals to protrude from the base. Each of the plate fins includes a plate surface which faces the plate surface of an adjacent one of the plate fins and which upwardly extends in a direction along the base. A plane parallel to at least one of the plate surfaces of the plate fins is oblique with respect to a vertical direction.

According to an illustrative aspect of the present invention, a vehicle lamp includes a semiconductor light emitting device, a thermally conductive portion which is in contact with the semiconductor light emitting device, a heatsink configured to dissipate a heat generated by the semiconductor light emitting device, and a housing in which the semiconductor light emitting device, the thermally conductive portion and the heatsink are accommodated. The heatsink includes a base which is in contact with the thermally conductive portion, and a plurality of plate fins which are arranged at intervals to protrude from the base. Each of the plate fins includes a plate surface which faces the plate surface of an adjacent one of the plate fins and which upwardly extends in a direction along the base. The housing includes an inner surface which is arranged above the plurality of plate fins and which is oblique with respect to a vertical direction.

Other aspects and advantages of the invention will be apparent from the following description, the drawings and the claims.

DETAILED DESCRIPTION OF EXEMPLARY EMBODIMENTS OF INVENTION

Hereinafter, exemplary embodiments of the invention will be explained with reference to the drawings. The following exemplary embodiments are examples only and do not limit the scope of the present invention.

First Exemplary Embodiment

Figure 1:
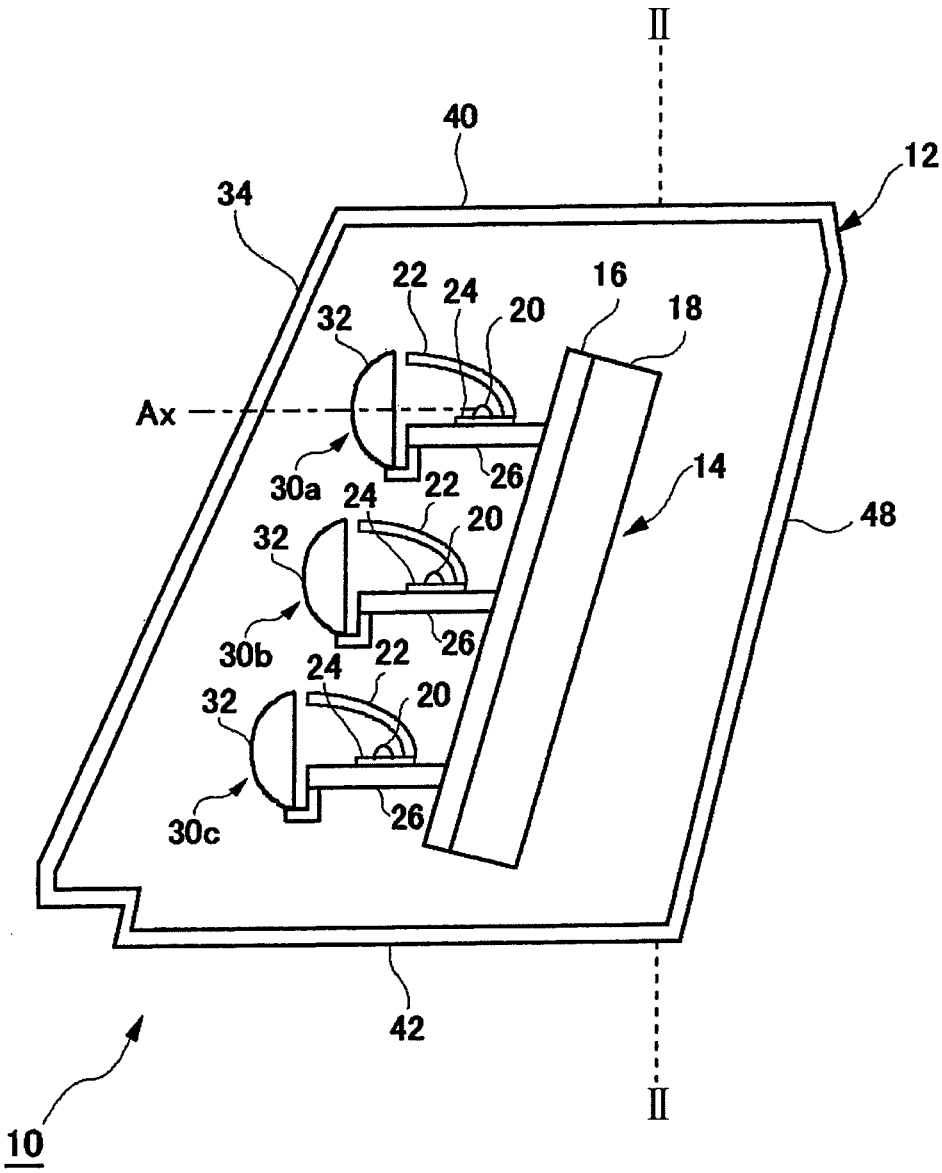
FIG. 1 is a schematic sectional view of a vehicle lamp according to a first exemplary embodiment of the present invention.

FIG. 1 is a schematic sectional view of a vehicle lamp 10 according to a first exemplary embodiment of the present invention. As shown in FIG. 1, the vehicle lamp 10 is configured such that a first lamp unit 30*a*, a second lamp unit 30*b*, a third lamp unit 30*c* and a heatsink 14 are accommodated in a housing 12.

The first lamp unit 30*a*, the second lamp unit 30*b*, and the third lamp unit 30*c* are so-called projector type lamp units, and each of the lamp units 20*a*, 20*b*, 20*c* uses an LED as a light source. Hereinafter, the first lamp unit 30*a*, the second lamp unit 30*b*, and the third lamp unit 30*c* will generically be referred to as lamp units 30 where appropriate.

Each of the lamp units 30 includes an LED 20, a substrate 24, a reflector 22, a fixing member 26, and a projection lens 32. The LED 20 is, for example, a white LED having an LED chip (not shown) and a hemispherical cap that covers the LED chip. The LED 20 is disposed on the substrate 24 which is formed of thermally conductive and electrically insulative material, e.g., ceramics. The LED 20 is arranged on an optical axis Ax of the corresponding lamp unit 30 such that a light emitting direction of the LED 20 is oriented in a direction perpendicular to the optical axis Ax. Electric power is supplied to the LED 20 via a wiring pattern formed on the substrate 24.

The reflector 22 is formed in a shape of a semidome using, e.g., polycarbonate, and is disposed above the LED 20. An inner surface of the reflector 22 has a reflecting surface which forwardly reflects and converges light emitted from the LED 20 toward the optical axis Ax.

The projection lens 32 is, for example, a planoconvex aspheric lens having a convex front surface and a flat rear surface, and is configured to forwardly project a light source image, which is formed on a rear focal plane, as an inverted image. The fixing member 26 is formed by die casting using an aluminum-based metal so as to be elongated in a plate-like manner. The substrate 24, on which the LED 20 is mounted, and the reflector 22 are fixed onto an upper surface of the fixing member 26. Further, the projection lens 32 is attached to a front end portion of the fixing member 26.

A rear end portion of the fixing member 26 of each of the lamp units 30 is attached to the heatsink 14. The heatsink 14 is formed of high thermal conductive metal such as aluminum, and includes a base 16 and plate fins 18. The base 16 is a plate-like member. The fixing members 26 are attached to a front surface of the base 16. The plate fins 18 are arranged to protrude from a rear surface of the base 16.

Each of the lamp units 30 are attached to the heatsink 14 in a manner described above, and the heatsink 14 is attached inside the housing 12 via a support member (not shown) such that the light irradiating from each of the lamp units 30 is directed in a forward direction of the vehicle lamp 10.

The housing 12 includes six walls, namely, a front wall 34, a rear wall 48, a top wall 40, a bottom wall 42, a left side wall 44 and a right side wall 46. In this exemplary embodiment, the top wall 40 and the bottom wall 42 are arranged to extend horizontally, and the left side wall 44 and right side wall 46 are arranged to be perpendicular to the top wall 40 and the bottom wall 42 (see FIG. 2). Each of the walls of the housing 12 is formed is a shape of a flat plate.

The front wall 34 of the housing 12 is made of transparent resin, e.g., polycarbonate, so as to transmit the light irradiating from each of the lamp units 30. It is advantageous for the housing 12 to have an airtight structure, i.e., hermetically sealed structure, so that a reduction in light amount level, which may be caused by dust that attaches to the lamp unit 30, can be prevented.

Figure 2:
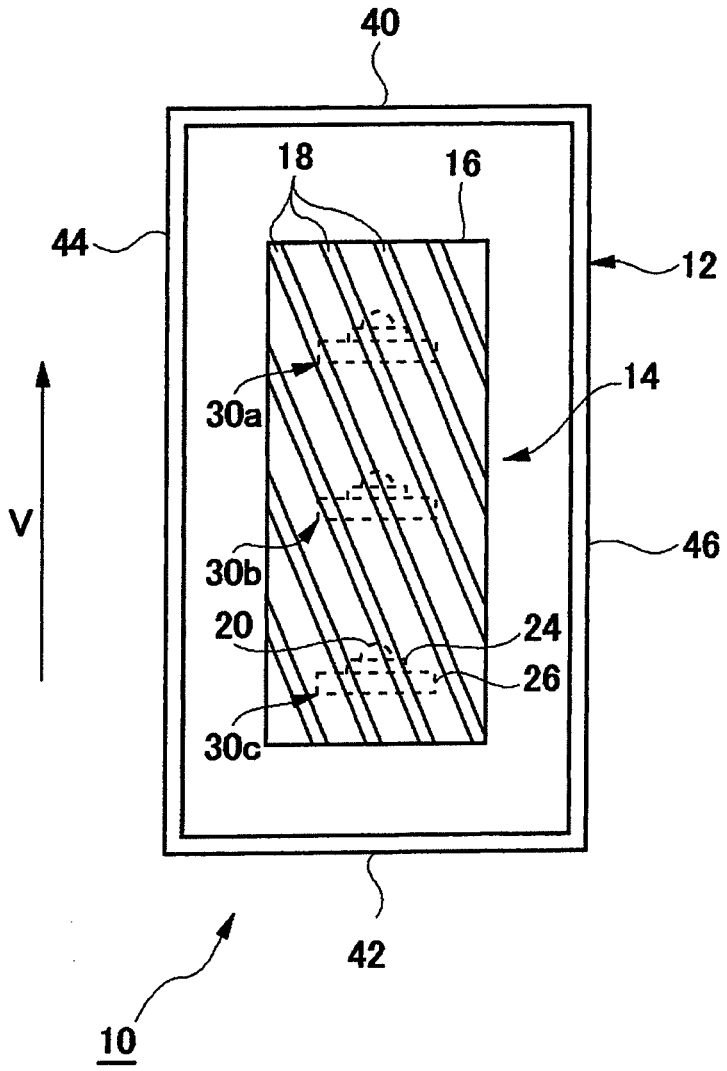
FIG. 2 is a schematic sectional view taken along the line II-II of FIG. 1.

FIG. 2 is a schematic sectional view of the vehicle lamp 10, taken along the line II-II of FIG. 1. FIG. 2 illustrates an interior of the housing 12, viewed from a side of the rear wall 48. In this sectional view, the first lamp unit 30*a*, the second lamp unit 30*b* and the third lamp unit 30*c*, which are actually hidden when viewed from the side of the rear wall 48, are indicated by dashed lines in order to illustrate the positional relationship between the heatsink 14 and each of the first lamp unit 30*a*, the second lamp unit 30*b* and the third lamp unit 30*c*.

The base 16 of the heatsink 14 is a plate-like member having a rectangular shape. The base 16 is arranged such that the long sides of the rectangular shape are parallel to the left side wall 44 and the right side wall 46 and such that the short sides of the rectangular shape are parallel to the top wall 40 and the bottom wall 42. The heatsink 14 is provided near the center of the interior of the housing 12.

As described above, the lamp units 30 are attached to the front surface of the base 16. The plate fins 18 are arranged to protrude in parallel from the rear surface of the base 16 at intervals. A direction in which the plate fins 18 extend is set such that a plane parallel to the plate fins 18 is oblique with respect to a vertical direction V. As shown in FIG. 2, the plate fins 18 are arranged to upwardly extend from right to left. The direction in which the plate fins 18 extend is a longitudinal direction of each of the plate fins 18. The plane parallel to the plate fins 18 is a plane that is parallel to at least one of plate surfaces of the plate fins 18. The plate surfaces of adjacent ones of the plate fins 18 face one another.

The first lamp unit 30*a*, the second lamp unit 30*b* and the third lamp unit 30*c* are attached to the heatsink 14. More specifically, the first lamp unit 30*a*, the second lamp unit 30*b* and the third lamp unit 30*c* are arranged such that a direction in which the first lamp unit 30*a*, the second lamp unit 30*b* and the third lamp unit 30*c* are aligned is parallel to the longitudinal direction of the base 16 of the heatsink 14. In addition, the first lamp unit 30*a*, the second lamp unit 30*b* and the third lamp unit 30*c* are aligned from above in this order.

Figure 3:
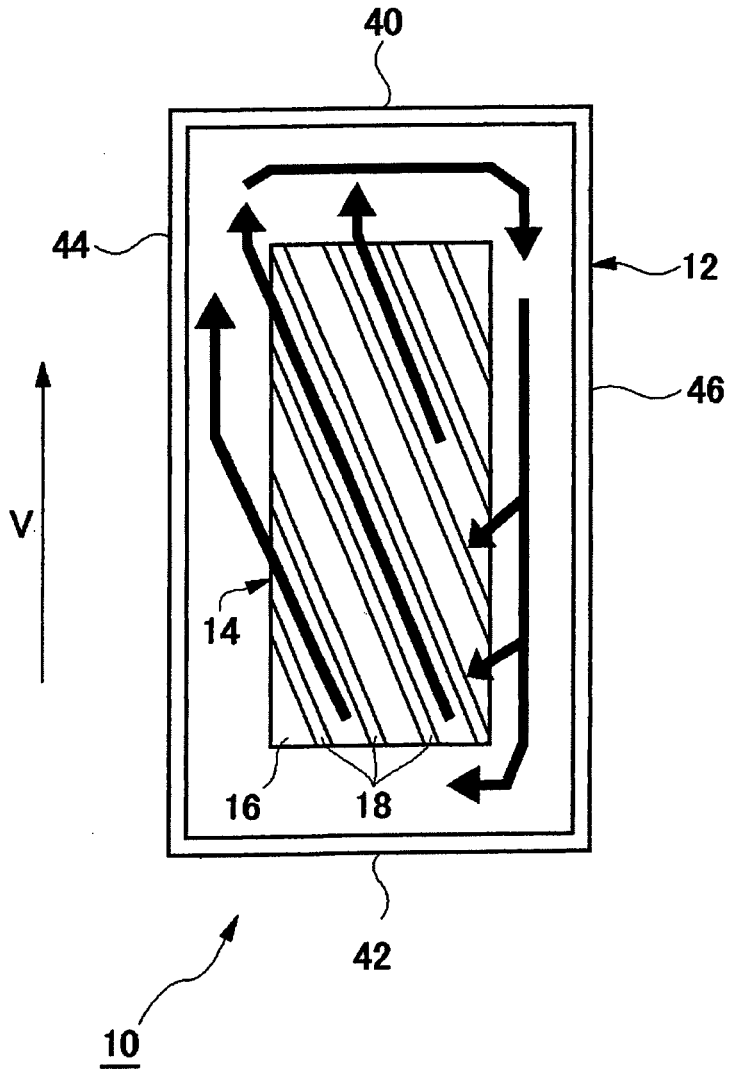
FIG. 3 is an explanatory view illustrating an air convection inside the vehicle lamp according to the first exemplary embodiment.

FIG. 3 is an explanatory view illustrating the air convection in the vehicle lamp 10 according to the first exemplary embodiment. In FIG. 3, thick arrows represent air flows, respectively. When the LED 20 emits light, a heat generated by the light emission is transmitted to the fixing member 26 via the substrate 24 with which the LED 20 is in contact, i.e., thermally connected. The heat transmitted to the fixing member 26 is further transmitted to the base 16 of the heatsink 14, which is in contact with, i.e., thermally connected to, the rear end portion of the fixing member 26. The substrate 24 and the fixing member 26 function as a thermally conducting portion which transmits the heat generated by the LED 20 to the heatsink 14. The heat transmitted to the base 16 of the heatsink 14 is transmitted to the plate fins 18, and the heat is dissipated from the plate fins 18 to the surrounding air. The air is warmed by the heat radiated from the plate fins 18, and rises through the gaps between the adjacent plate fins 18 along the direction in which the plate fins 18 extend. That is, the warmed air rises from right to left in FIG. 3.

As shown in FIG. 1, the rear surface of the base 16 is downwardly oblique with respect to the vertical direction. Due to this arrangement, the air flow between the adjacent plate fins 18 can be regulated more reliably.

In the first exemplary embodiment, the direction in which the plate fins 18 extend is set such that a plane parallel to the plate fins 18 is oblique with respect to the vertical direction. That is, the direction in which the plate fins 18 extend is oblique with respect to the inner surface of the left side wall 44 of the housing 12. Accordingly, a part of the air that is warmed by the heat dissipated from the plate fins 18 rises from the right to left through the gaps between the adjacent plate fins 18, and the flow of the air turns in the vertical direction after colliding with the inner surface of the left side wall 44 of the housing 12. Subsequently, the air flows along the inner surface of the top wall 40, and circulates in a clockwise direction inside the housing 12.

For example, in a case in which a related art vehicle lamp has a housing that is similar to the housing 12 of the first exemplary embodiment and a direction in which the plate fins extend is set such that a plane parallel to the plate fins is parallel to the vertical direction, air warmed by the heat radiated from the plate fins 18 collides directly with the inner surface of the top surface of the housing after passing through the gaps between the adjacent plate fins, and is split into rightward air flow and leftward air flow. In this case, air circulations in different directions are created, which hinder one another from circulating in their respective directions. Thus, it is difficult to enhance the air circulation inside the housing.

By contrast, according to the first exemplary embodiment, the direction in which the plate fins 18 extend is set such that a plane parallel to the plate fins 18 is oblique with respect to the vertical direction. Consequently, the air which is warmed by the heat dissipated from the LED 20 and which upwardly flows through the gaps between the adjacent plate fins 18 is circulated in a single circulating direction inside the housing 12. Accordingly, as compared with the related art case in which the air is split to circulate in different directions inside the housing 12, the air circulation is enhanced. Thus, the heat generated by the LED 20 can efficiently be dissipated. Consequently, reduction in the luminous efficiency of the LED 20 can be restrained.

Further, as described above, in the first exemplary embodiment, the first lamp unit 30*a*, the second lamp unit 30*b* and the third lamp unit 30*c* are arranged such that the direction in which the first lamp unit 30*a*, the second lamp unit 30*b* and the third lamp unit 30*c* are aligned is oblique with respect to the direction in which the plate fins 18 extend. According to this configuration, the air warmed by the heat generated by, e.g., the second lamp unit 30*b* and the third lamp unit 30*c* flows upwardly and leftwardly along the direction in which the plate fins 18 extend, which is oblique with respect to the direction in which the first lamp unit 30*a*, the second lamp unit 30*b* and the third lamp unit 30*c* are aligned. Therefore, as compared with a case in which the lamp units are aligned in the direction in which the plate fins extend, the first lamp unit 30*a* is less affected by the heat generated from the second lamp unit 30*b* and the third lamp unit 30*c* that are provided below the first lamp unit 30*a*. This is the same with the second lamp unit 30*b*. That is, as compared with a case in which the lamp units are aligned in the direction in which the plate fins extend, the second lamp unit 30*b* is less affected by the heat generated from the third lamp unit 30*c* which is provided below the second lamp unit 30*b*. Consequently, reduction in the luminous efficiency of each of the first lamp unit 30*a* and the second lamp unit 30*b* can be restrained.

Furthermore, according to the first exemplary embodiment, because the luminous efficiency is enhanced, the number of the plate fins 18 can be reduced, as compared with the case in which the plane parallel to the plate fins is parallel to the vertical direction. Consequently, reduction in the size and weight of the vehicle lamp 10 can be achieved.

An advantageous inclination angle of the plane parallel to the plate fins 18 with respect to the vertical direction V can be determined through an experiment or a simulation, depending on the configuration of the housing 12, the relative position of the heatsink 14 with respect to the housing 12, and the intervals between the adjacent plate fins 18. The inclination angle $\theta$ of the plane parallel to the plate fins 18 with respect to the vertical direction V may be within a range of about $0° < \theta < 45°$. Further, the intervals between the adjacent plate fins 18 may be about 1.3 to about 1.7 times the intervals between the adjacent plate fins in the case in which the plane parallel to the plate fins is parallel to the vertical direction.

Second Exemplary Embodiment

Figure 4:
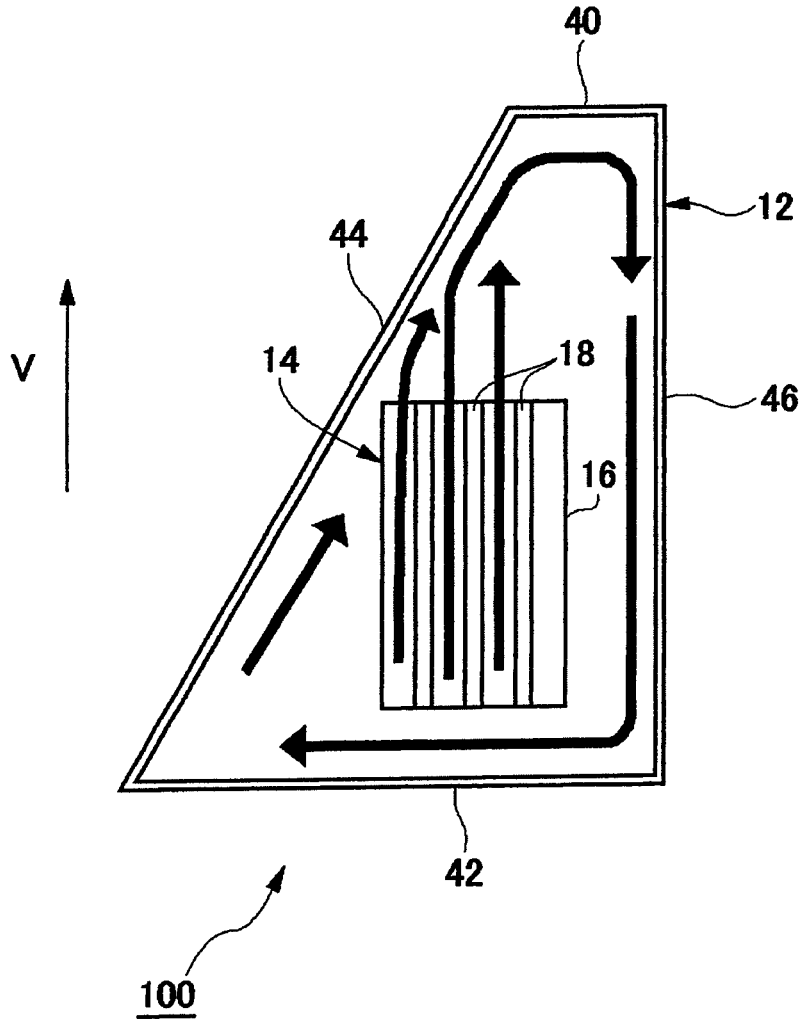
FIG. 4 is an explanatory view of a vehicle lamp according to a second exemplary embodiment of the present invention.

FIG. 4 is a schematic sectional view of a vehicle lamp 100 according to a second exemplary embodiment of the present invention. In FIG. 4, thick arrows represent air flows, respectively. Components which are the same or correspond to those of the vehicle lamp 10 of the first exemplary embodiment are designated with the same reference numerals, and repetitive description thereof will be omitted.

As shown in FIG. 4, the housing 12 of the vehicle lamp 100 is configured such that the top wall 40 and the bottom wall 42 extend horizontally, the right side wall 46 is perpendicular to the top wall 40 and the bottom wall 42, and the left side wall 44 is oblique with respect to the vertical direction V. The left side wall 44 is inclined so as to extend rightwardly and upwardly from the bottom wall 42 to the top wall 40.

The plurality of plate fins 18 are arranged to protrude in parallel from the rear surface of the base 16 of the heatsink 14 at intervals. The direction in which the plate fins 18 extend is oblique with respect to the inner surface of the left side wall 44 of the housing 12. The direction in which the plate fins 18 extend is set such that a plane parallel to the plate fins 18 is parallel to the vertical direction V.

In the vehicle lamp 100 of the second exemplary embodiment, the heat generated by the light emission from the LED 20 is transmitted to the heatsink 14 via the substrate 24 and the fixing member 26. The heat transmitted to the heatsink 14 is dissipated from the plate fins 18 to the surrounding air. The air is warmed by the heat radiated from the plate fins 18, and rises through the gaps between the adjacent plate fins 18 along the direction in which the plate fins 18 extend. That is, the warmed air rises in the vertical direction V.

In the second exemplary embodiment, the direction in which the plate fins 18 extend is oblique with respect to the inner surface of the left side wall 44 of the housing 12. Accordingly, a part of the air warmed by the heat radiated from the plate fins 18 rises in the vertical direction V through the gaps between the adjacent plate fins 18, and collides with the inner surface of the left side wall 44 of the housing 12. Subsequently, the air flows upwardly along the inner surface of the top wall 40 and circulates in a clockwise direction inside the housing 12. Accordingly, as compared with the related art case in which the air is split to circulate in different directions inside the housing 12, the air circulation of the vehicle lamp according to the second exemplary embodiment is enhanced. Thus, the heat generated by the LED 20 can efficiently be dissipated. Consequently, reduction in the luminous efficiency of the LED 20 can be restrained.

According to the second exemplary embodiment, the direction in which the plate fins 18 extend is oblique with respect to the inner surface of the left side wall 44 of the housing 12. However, alternatively, the direction in which the plate fins 18 extend may be oblique with respect to the inner surface of the right side wall 46 of the housing 12. In this case, the air would circulate in a counterclockwise direction.

The inclination angle of the direction in which the plate fins 18 extend with respect to the inner surface of the side wall 44 or 46 of the housing 12 can be determined through an experiment or a simulation, depending on the configuration of the housing 12, the relative position of the heatsink 14 with respect to the housing 12 and the intervals between the adjacent plate fins 18.

Third Exemplary Embodiment

Figure 5:
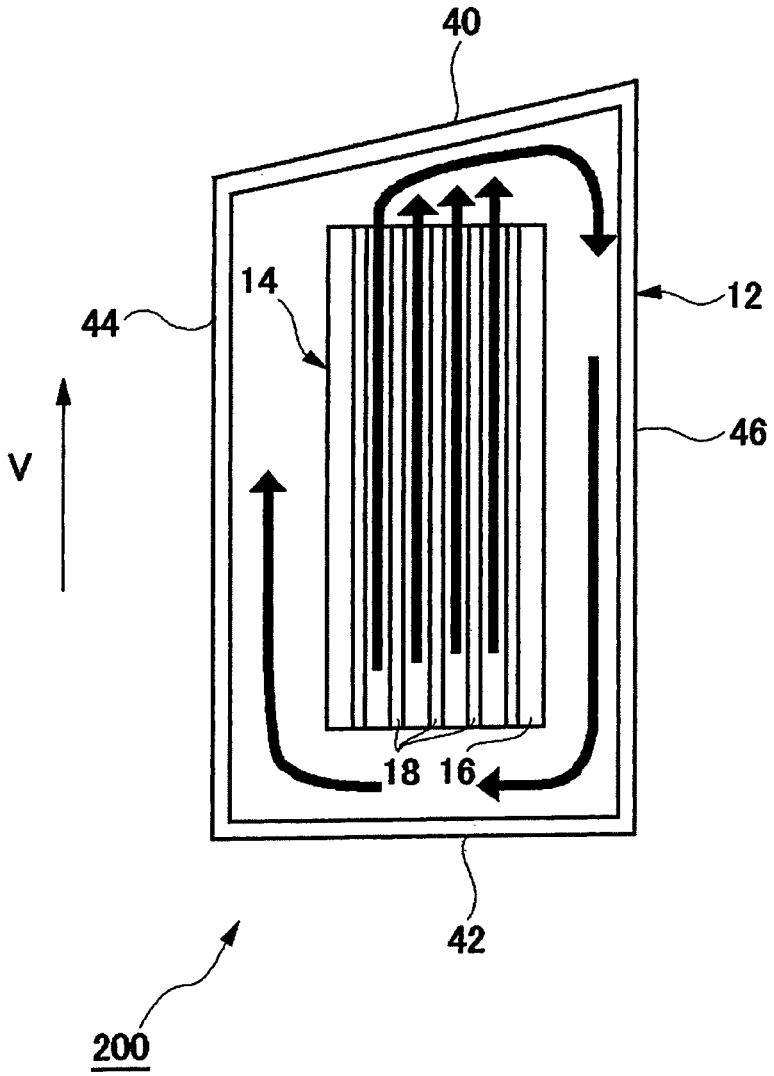
FIG. 5 is an explanatory view of a vehicle lamp according to a third exemplary embodiment of the present invention.

FIG. 5 is a schematic sectional view of a vehicle lamp 200 according to a third exemplary embodiment of the invention. In FIG. 5, thick arrows represent air flows, respectively. Components which are the same or corresponding to those of the vehicle lamp 10 of the first exemplary embodiment are designated with the same reference numerals, and repetitive description thereof will be omitted.

As shown in FIG. 5, the housing 12 of the vehicle lamp 200 is configured such that the bottom wall 42 extends in a horizontal direction, the left side wall 44 and the right side wall 46 are perpendicular to the bottom wall 42, and the top wall 40 is oblique with respect to the horizontal direction. The top wall 40 is inclined so as to extend rightwardly and upwardly from the left side wall 44 toward the right side wall 46.

The plurality of plate fins 18 are arranged to protrude in parallel from the rear surface of the base 16 of the heatsink 14. The direction in which the plate fins 18 extend is set such that the inner surface of the top wall 40 of the housing 12 and a plane parallel to the plate fins 18 form an oblique angle. Further, the direction in which the plate fins 18 extend is set such that the plane parallel to the plate fins 18 is parallel to the vertical direction V.

In the vehicle lamp 200 of the third exemplary embodiment, the heat generated by the light emission from the LED 20 is transmitted to the heatsink 14 via the substrate 24 and the fixing member 26. The heat transmitted to the heatsink 14 is dissipated from the plate fin 18 to the surrounding air. The air is warmed by the heat radiated from the plate fin 18, and rises through the gaps between the adjacent plate fins 18 along the direction in which the plate fins 18 extend. That is, the warmed air rises in the vertical direction V.

In the third exemplary embodiment, the inner surface of the top wall 40 of the housing 12 and the plane parallel to the plate fins 18 intersect at an oblique angle. Accordingly, the air warmed by heat radiated from the plate fins 18 rises in the vertical direction V through the gaps between the adjacent plate fins 18, and collides with the inner surface of the top wall 40 of the housing 12. Subsequently, the air flows rightwardly along the inner surface of the top wall 40. Then, the air flows along the inner surface of the right side wall 46, and circulates in a clockwise direction inside the housing 12. Accordingly, as compared with the related art case in which the air is split to circulate in different directions inside the housing 12, the air circulation is enhanced. Thus, the heat generated from the LED 20 can efficiently be dissipated. Consequently, reduction in the luminous efficiency of the LED can be restrained.

According to the third exemplary embodiment, the top wall 40 is inclined to extend rightwardly and upwardly from the left side wall 44 toward the right side wall 46. However, alternatively, the top wall 40 may be inclined to extend leftwardly and upwardly from the right side wall 46 toward the side of the left side wall 44. In this case, the direction of the air circulation becomes a counterclockwise direction.

The angle at which the inner surface of the top wall 40 of the housing 12 intersects with the plane parallel to the plate fins 18 can be determined through an experiment or a simulation, depending on the configuration of the housing 12, the relative position of the heatsink 14 with respect to the housing 12 and the intervals between the adjacent plate fins 18.

According to the exemplary embodiments described above, the vehicle lamp 10, 100, 200 includes the semiconductor light emitting device 20, the thermally conductive portion 24, 26 which is in contact with the semiconductor light emitting device 20, the heatsink 14 configured to dissipate a heat generated by the semiconductor light emitting device 20, and the housing 12 in which the semiconductor light emitting device 20, the thermally conductive portion 24, 26 and the heatsink 14 are accommodated. The heatsink 14 includes the base 16 which is in contact with the thermally conductive portion 24, 26, and a plurality of plate fins 18 which are arranged at intervals to protrude from the base 16. Each of the plate fins 16 has a plate surface which faces the plate surface of an adjacent one of the plate fins 18 and which upwardly extends in a direction along the base 16. According to the first exemplary embodiment, the plane parallel to at least one of the plate surfaces of the plate fins 18 is oblique with respect to a vertical direction V. According to the second and third exemplary embodiments, the housing 12 includes an inner surface which is arranged above the plurality of plate fins 18 and which is oblique with respect to the vertical direction V. In either of the configurations, it is possible to regulate the air inside the housing 12 to circulate in one direction around the heatsink 14.

Various elements of the respective exemplary embodiments described above may be combined to further enhance the heat dissipation inside the housing 12.

For example, in the second and third exemplary embodiments described above, the lamp units 30 may be aligned in an oblique direction with respect to the vertical direction, i.e., with respect to the plane parallel to the plate fins 18, so that the first lamp unit 30*a* is less affected by the heat generated in the second and third lamp units 30*b*, 30*c* and the second lamp unit 30*b* is less affected by the heat generated by the third lamp unit 30*c*.

In first exemplary embodiment, moreover, the inner surface of the housing 12 disposed above the plate fins 18, i.e. the inner surface of the upper wall 40, may be oblique with respect to the vertical direction like in the third exemplary embodiment and/or the inner surface of the left side wall 44 may be oblique with respect to the vertical direction so as to be disposed above the plate fins 18 the like in the second exemplary embodiment, so that the direction of the air circulation is regulated more reliably.

While the present invention has been shown and described with reference to certain exemplary embodiments thereof, it will be understood by those skilled in the art that various changes in form and details may be made therein without departing from the spirit and scope of the invention as defined by the appended claims.

For example, while an LED is used as the light source of each of the lamp units 30 in the exemplary embodiments described above, other types of semiconductor light emitting devices, e.g., semiconductor lasers, may be used as a light source of one or more of the lamp units 30.

Further, while the lamp units 30 are the projector type lamp units in the exemplary embodiments described above, one or more paraboloidal reflector type lamp units and/or a non-reflector type may be alternatively or additionally used.

Furthermore, while the number of lamp units 30 is three in the exemplary embodiments described above, the number of lamp units may be one, two, or more than three.

In any event, it will be understood that the above changes and modifications are not limiting, and these and other changes and modifications may be made without departing from the scope of the appended claims.

What is claimed is:

1. A vehicle lamp comprising:

a semiconductor light emitting device;

a thermally conductive portion which is in contact with the semiconductor light emitting device;

a heatsink configured to dissipate a heat generated by the semiconductor light emitting device; and a housing in which the semiconductor light emitting device, the thermally conductive portion and the heatsink are accommodated, wherein the heatsink comprises:

a base which is in contact with the thermally conductive portion; and a plurality of plate fins which are arranged at intervals to protrude from the base, each of the plate fins comprising a plate surface which faces the plate surface of an adjacent one of the plate fins and which upwardly extends in a direction along the base, the plate fins being accommodated within the housing, wherein the housing comprises an inner surface which is arranged directly above the plurality of plate fins and which is oblique with respect to a vertical direction; whereby air flowing between the plate fins is directed toward the inner surface, wherein the base comprises:

a front surface to which the thermally conductive portion is fixed; and a rear surface from which the plurality of plate fins rearwardly protrudes, wherein the rear surface of the base is downwardly oblique with respect to the vertical direction.

2. A vehicle lamp comprising:

a semiconductor light emitting device;

a thermally conductive portion which is in contact with the semiconductor light emitting device;

a heatsink configured to dissipate a heat generated by the semiconductor light emitting device; and a housing in which the semiconductor light emitting device, the thermally conductive portion and the heatsink are accommodated, wherein the heatsink comprises:

a base which is in contact with the thermally conductive portion; and a plurality of plate fins which are arranged at intervals to protrude from the base, each of the plate fins comprising a plate surface which faces the plate surface of an adjacent one of the plate fins and which upwardly extends in a direction along the base, the plate fins being accommodated within the housing, wherein the housing comprises an inner surface which is arranged directly above the plurality of plate fins and which is oblique with respect to a vertical direction; whereby air flowing between the plate fins is directed toward the inner surface, wherein the housing is hermetically sealed.

3. The vehicle lamp according to claim 2, wherein the housing comprises a top wall, a side wall, a bottom wall, a front wall which is transparent, and a rear wall, and the inner surface of one of the top wall and the side wall is oblique with respect to the vertical direction.

4. The vehicle lamp according to claim 2, further comprising:

another semiconductor light emitting device; and another thermally conductive portion which is in contact with the another semiconductor light emitting device, wherein the base is in contact with the another thermally conductive portion, and a direction in which the thermally conductive portion and the another thermally conductive portion are aligned on the base is oblique with respect to a plane parallel to at least one of the plate of the plate surfaces of the plate fins.

5. The vehicle lamp according to claim 2, wherein a plane parallel to at least one of the plate surfaces of the plate fins is parallel to the vertical direction.

* * * * *